US010682580B2

(12) United States Patent
Crouse et al.

(10) Patent No.: US 10,682,580 B2
(45) Date of Patent: Jun. 16, 2020

(54) INTERACTIVE CONSTRUCTION TOY SYSTEM

(71) Applicant: Traxart Toys LLC, Longmont, CO (US)

(72) Inventors: Susan E. Crouse, Longmont, CO (US); John Adam Kemp, Longmont, CO (US); Hunter J. Reid, Lafayette, CO (US); Emily E. Scott, Denver, CO (US); Taylor R. Scott, Denver, CO (US)

(73) Assignee: Traxart Toys LLC, Longmont, CO (US)

( * ) Notice: Subject to any disclaimer, the term of this patent is extended or adjusted under 35 U.S.C. 154(b) by 0 days.

(21) Appl. No.: 15/882,949

(22) Filed: Jan. 29, 2018

(65) Prior Publication Data

US 2018/0214786 A1 Aug. 2, 2018

Related U.S. Application Data

(60) Provisional application No. 62/451,318, filed on Jan. 27, 2017.

(51) Int. Cl.
*A63H 33/08* (2006.01)
*A63H 33/04* (2006.01)
(Continued)

(52) U.S. Cl.
CPC ..... *A63H 33/042* (2013.01); *A63H 18/021* (2013.01); *A63H 33/105* (2013.01);
(Continued)

(58) Field of Classification Search
CPC .... A63H 33/26; A63H 33/042; A63H 33/101; A63H 33/102; A63H 33/105;
(Continued)

(56) References Cited

U.S. PATENT DOCUMENTS 2,170,771 A * 8/1939 Benjamin ..... A63H 33/102 446/103
2,414,716 A * 1/1947 Carson ..... A63H 33/105 446/112
(Continued)

OTHER PUBLICATIONS

Steren, UG57 Male N-Type Coaxial Cable Connector 4 GHz Satellite System Coaxial Double Barrel Connector Jointed Adapter, UG213, viewed on Feb, 14 2018, SummitSource.com Catalog.

*Primary Examiner* — Joseph B Baldori

(57) ABSTRACT

Embodiments include a construction toy kit having component parts capable of being assembled in a configuration chosen by the user. The kit may contain a connector extending from a first end to a second end, having a securement comprising a first retainer feature, a second retainer feature and a third retainer feature. The connector may further have a first grip extending from the first end toward the securement, where the first grip is sized to receive a feature of a building panel. The kit may also contain a multiple building panels of various configurations, a mat used as a base for erecting a structure and multiple sensor components. These components among others may be assembled to create structure such as a race course for robotic toys. The sensor elements may be implemented by the user to sense various actions of the robotic toy, and respond as chosen by the user.

17 Claims, 13 Drawing Sheets

(51) Int. Cl.
*A63H 33/26* (2006.01)
*A63H 33/10* (2006.01)
*A63H 18/02* (2006.01)

(52) U.S. Cl.
CPC ..... *A63H 33/108* (2013.01); *A63H 33/26* (2013.01); *A63H 2200/00* (2013.01)

(58) Field of Classification Search
CPC .. A63H 33/106; A63H 33/107; A63H 33/108; A63H 33/12; A63H 18/021
USPC ..... 446/91, 102, 103, 104, 108, 111, 112, 446/113, 114, 115, 120, 121, 122
See application file for complete search history.

(56) References Cited

U.S. PATENT DOCUMENTS 2,871,619 A 2/1959 Walters
2,885,822 A * 5/1959 Onanian ..... A63H 33/101 174/138 D
3,224,136 A * 12/1965 Moryl ..... A63H 33/12 446/100
3,510,979 A * 5/1970 Fischer ..... A63H 33/105 446/102
3,577,660 A * 5/1971 Kenney ..... G09B 23/26 434/280
3,611,609 A * 10/1971 Reijnhard ..... A63H 33/086 446/121
3,681,870 A * 8/1972 Alpert ..... A63H 33/108 446/111
3,698,123 A * 10/1972 Heldt ..... A63H 33/101 446/120
3,769,661 A * 11/1973 Bengtsson ..... E04H 15/32 24/581.1
4,182,072 A * 1/1980 Much ..... A63H 33/065 220/4.24
4,186,533 A * 2/1980 Jensen ..... E04B 2/7425 52/184
4,214,404 A * 7/1980 Fischer ..... A63H 33/102 446/122
4,361,979 A * 12/1982 Petersson ..... A63H 33/108 403/292
4,461,116 A * 7/1984 Bach ..... A63H 33/102 446/128
4,484,407 A 11/1984 Petersson
4,493,425 A * 1/1985 Yoshida ..... A47B 47/0033 206/504
D281,440 S * 11/1985 Petersson ..... D21/487
4,902,259 A * 2/1990 Ziegler ..... A63H 33/065 446/117
5,009,599 A * 4/1991 Mueller ..... G09B 1/10 434/81
5,816,882 A * 10/1998 Guegan ..... A63H 33/12 446/123
5,881,515 A * 3/1999 George ..... A63H 33/044 403/294
6,015,150 A 1/2000 Giguere
6,231,416 B1 * 5/2001 Clever ..... A63H 33/082 446/108
6,325,694 B1 * 12/2001 Clever ..... A63H 33/082 403/165
6,626,605 B1 * 9/2003 Dean ..... F16B 7/025 108/147.12
6,645,032 B2 * 11/2003 Barringer ..... A63H 33/10 446/108
6,736,691 B1 * 5/2004 Bach ..... A63H 33/101 446/116
7,186,050 B2 3/2007 Dean et al.
7,510,457 B2 3/2009 Hussa-Lietz
7,588,476 B2 9/2009 Hammond
7,736,211 B2 * 6/2010 Marzetta ..... A63H 33/106 446/113
7,942,717 B2 * 5/2011 Chou ..... G06T 17/10 446/122
8,070,551 B1 12/2011 Clever
8,371,894 B1 * 2/2013 Rosen ..... A63H 33/086 446/102
8,801,491 B2 * 8/2014 Bruder ..... A63H 33/101 446/124
9,168,464 B2 * 10/2015 Karunaratne ..... A63H 33/086
9,498,703 B2 * 11/2016 McCoskey ..... A63H 33/106
9,500,215 B2 * 11/2016 Kim ..... F16B 2/26

* cited by examiner

1300

INTERACTIVE CONSTRUCTION TOY SYSTEM

CROSS REFERENCE TO RELATED APPLICATIONS

This application claims the benefit of U.S. Provisional Application No. 62/451,318, filed Jan. 27, 2017, which is incorporated by reference in its entirety for all purposes.

TECHNICAL FIELD

The present disclosure relates to an interactive modular construction toy building system.

BACKGROUND

Construction toy systems generally encompass a range of different parts that may be assembled by a user to create a desired structure. Typical construction toys contain a variety of modular parts where many, if not all, of the parts can interface with other parts. For example, a brick building set may contain parts with common elements such as raised features and recessed features on each part. Every raised feature is substantially identical and every recessed feature accepts each raised feature. Therefore, so long as every part contains these common features it can interface with every other part in the set.

In typical construction toys, a vast variety of parts with differing shapes and sizes are provided. Each of these parts may be designed to serve a specific function. Thus, a user wishing to build a structure may use a large multitude of different pieces to create the desired structure. However, having a large multitude of parts may make building a desired structure take longer or result in the set costing more. Further, having a large variety of different parts may ultimately limit what can be built because a user may run out of one specific part while having a variety of other pieces that cannot fulfill the exhausted part's function.

The subject matter of the present disclosure is directed to overcoming this problem in which a user purchases a large number of limited-function construction pieces.

BRIEF SUMMARY

Among other things, embodiments include a construction toy system with modular components that allow a variety of structures to be created by a user. For example, some embodiments include a connector, a variety of building components of various shapes and sizes (e.g., flat panel components with a plurality of apertures extending through the flat surfaces, where the panel may have various shapes: square, rectangular, circular, and/or the like), a mat, a variety of sensors (e.g., motion sensor, force sensor, light sensor, and/or the like) that can wirelessly communicate with various other parts of the construction toy system and/or a robotic toy, and interactive components (e.g., a digital stopwatch, lights, and/or the like). The user may assemble these different components together to create structures such as race courses, obstacle courses and other arrangements for interacting with remote controlled or robotic toys, such as a SPHERO® robotic toy.

For example, in one embodiment, the user may use multiple connector elements to secure building components, such as panels, together to create a race course. The race course is built upon a mat acting as a base structure and has vertical walls secured in various orientations relative to each other by multiple connectors. The vertical walls create a path for one or more robotic toys to travel and may define a boundary area. Additionally, interactive components may be attached to the mat, walls or other components of the building system. The race course can contain multiple force sensors located at various points. A robotic toy may travel the course and each time it contacts a force sensor, the force sensor reacts in a way defined by the user. For example, the sensor may light up to indicate that it was contacted. The sensor may also communicate with a digital read-out to indicate a time at which it was contacted. In another embodiment, the sensor communicates with the robotic toy itself, providing it with feedback, such as indicating where the sensor is located within the course. This embodiment may also include a digital read-out that displays time in a stop watch fashion and a force sensor located at a finishing point of the structure. The user can then race the user's robotic toys through a course. A robotic toy may signal the stop watch to record and display a time when it triggers a force sensor in the race course.

In another embodiment, a course may be created from various building components to enable the robotic toy to accomplish a specific mission within the course. For example, various sensors (e.g., force sensor, light sensor, heat sensor, sound sensor, pressure sensor, and/or the like) can be located at different points of the course. One or more robotic toys may be placed in the course and given a mission to trigger (e.g., contact, block light to a sensor, and/or the like) the sensors. In this embodiment, the robotic toy may traverse the course until it contacts a sensor, which can light-up a certain color in response to being triggered. The sensor may also communicate with the robotic toy indicating that it has been triggered. In another embodiment, the robotic toy can also change color based on communications from a sensor.

In yet another embodiment, the construction toy system may be used to build three-dimensional structures such as buildings or architectural models. In such an embodiment, the panels may form walls or supporting walls for a vertical tower, and connectors may be used to join edges of different walls or panels and build on top of mats or other suitable substrates. For example, a mat may have multiple receptacles and/or recesses, which can be used to anchor connectors.

In some embodiments, the mat can also have holes that extend all the way through the material to anchor receptacles, for example if a swinging door is desired, at the base of walls or panels. The panels or walls may be made of a sufficiently rigid material to support the weight of a vertical structure. The mat may have interlocking edges that can be joined together with additional mats to create very large mazes, obstacle courses, or other structures. The structure may extend both vertically and horizontally as desired by a user, using the interlocking mats and combinations of connectors, receptacles, and panels to create a multitude of different layouts. The various components of the structure are designed to allow modular building and a near endless combination of parts into a multitude of arrangements. The materials selected for each component may be selected for properties of flexibility, rigidity, machinability, formability, and/or other desirable features in such a building or construction toy system.

Various building components provide a modular system allowing the user to create a variety of structures. Examples of some of the possible implementations of the building components are described herein. However, these examples are not meant to be limiting, as the components described herein can be assembled in a wide variety of different configurations by a user. Additionally, other components, such as various shaped panels (e.g., curved, angled, and/or the like), interactive components (e.g., sensors) can be incorporated into configurations and may interface with components described herein, even though not expressly described.

According to one embodiment, the construction toy system includes a panel and a connector. The panel is substantially planar having at least one aperture extending through the panel. The connector extends along a connector axis from a first end to a second end. The connector includes a securement having a first retainer feature extending radially from a first location along the connector axis. The securement has a second retainer feature extending radially from a second location along the connector axis. The securement further has a third retainer feature extending radially from the connector axis. The third retainer is flanked by the first retainer feature and the second retainer feature, such that the third retainer snap-fits to at least one aperture of the panel. The connector further comprises a first grip extending from the first end. The first grip extends toward the securement along the connector axis and has a recess sized to receive a feature of the panel. The connector also has a second grip extending from the second end toward the securement along the connector axis. The second grip has a second recess sized to receive a feature of the panel.

The securement of the connector can alternatively be referred to as a retaining segment. The retaining segment extends along the connector axis from a first end. The retaining segment abuts a receiver, which extends along the connector axis. The receiver has at least one prong extending from the retaining segment in the direction of the connector axis. The at least one prong defines a slot. The slot is sized to receive an edge of a panel.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

BRIEF DESCRIPTION OF THE DRAWINGS

The accompanying figures illustrate one or more embodiments of the disclosed construction toy system and, together with the detailed description, serve to explain the aspects and implementations of the construction toy system. In the appended figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label. Embodiments are described in conjunction with the appended figures.

Figure 1:
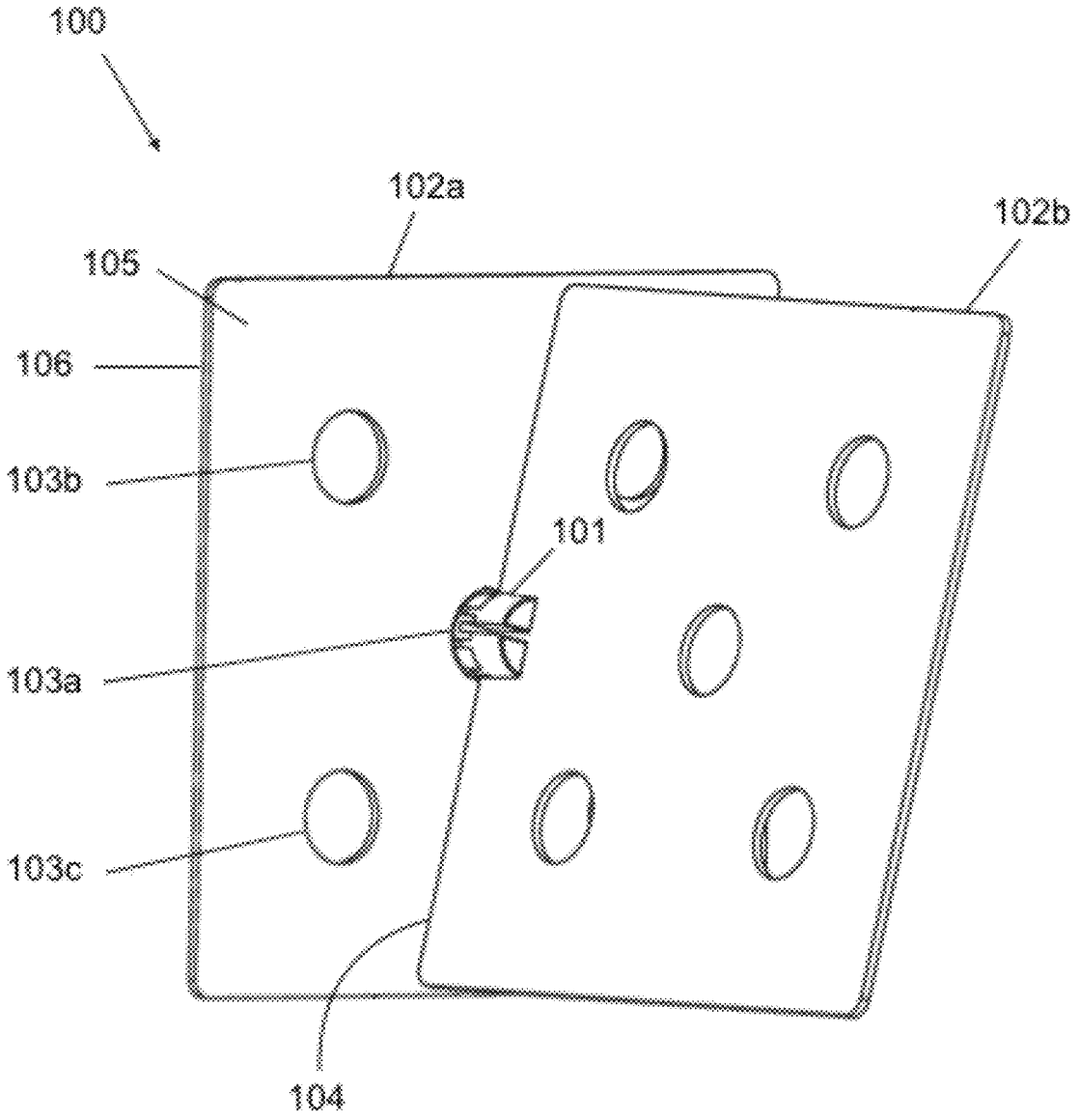
FIG. 1 shows a perspective view of an embodiment of a connector securing two building components.

While embodiments of the disclosure are amenable to various modifications and alternative forms, specific embodiments have been shown by way of example in the drawings and are described in detail below. The intention is not to limit the scope of the disclosure to the particular embodiments described. On the contrary, the disclosure is intended to cover all modifications, equivalents, and alternatives falling within the scope of the disclosure and the appended claims.

DETAILED DESCRIPTION

All illustrations of the drawings are for the purpose of describing selected embodiments and are not intended to limit the scope of the claims. The ensuing description provides exemplary embodiments, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

FIG. 1 shows one embodiment of a construction toy system 100 comprising a connector 101 and two panels 102*a*, 102*b*. The connector 101 secures a first panel 102*a* in a first orientation relative to the connector 101 by inserting the connector into an aperture 103*a* in the first panel 102*a*. The connector may also secure a second panel 102*b* in a second orientation relative to the connector 101 by inserting an edge 104 of the second panel 102*b* into a grip 208*a* (see FIG. 2) on the connector 101.

Figure 2:
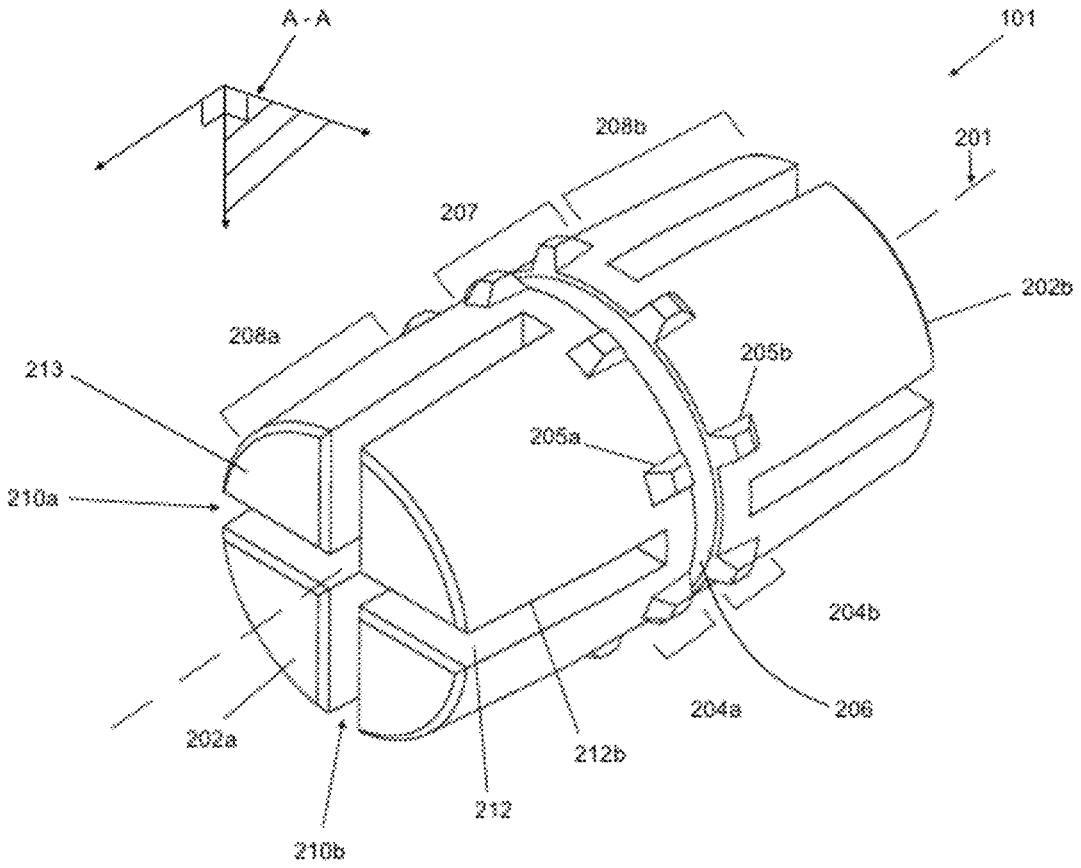
FIG. 2 shows a first perspective view of an embodiment of a connector.

In some embodiments, inserting the connector 101 into an aperture 103*a* on the panel 102*a* allows the panel 102*a* to rotate about a connector axis 201 while the connector 101 is inserted into the aperture 103*a* (see FIG. 2.). That is, the panel 102*a* is retained in a substantially orthogonal position relative to the connector axis 201, but can rotate about the connector 101 in one or more planes that are substantially orthogonal to the connector axis 201. In this embodiment, the second panel 102*b* is maintained in a fixed relation relative to the connector 101. Therefore, the first panel 102*a* also rotates relative to the second panel 102*b* when the first and second panels 102*a*, 102*b* are coupled by the connector 101 as shown in FIG. 1. The ability of panel 102*a* to rotate can be a building feature of a larger toy system and allows for moving parts such as doorways, moving ramps, tilting floor and wall panels among others. A gate may be formed by including at least one panel 102 configured to pivot relative to other parts in a toy system thereby allowing a toy or any device to pass through the gate by applying pressure and pivoting the panel 102 on a hinge created by a connector 101 that allows rotation relative to other parts of the system.

In one embodiment, the connector 101 may be formed as a single molded piece. In such embodiment, the connector 101 may be created from any material, including but not limited to plastic. In some embodiments, the connector 101 is molded, for example injection molded, compression molded, blow molded, rotational molded, or other molding techniques. In another embodiment, the connector 101 is machined from various materials including, metals, plastics, wood, and/or combinations thereof. The connector 101 may also be formed by three-dimensional printing, or other rapid prototyping techniques. In yet another embodiment, different portions of the connector 101 are formed separately and secured together in subsequent manufacturing operations. Additionally, different portions of the connector 101 can be formed from different materials. For example, the securement section can be molded from ABS plastic, while the grips can be formed from a nylon plastic.

Embodiments of the present disclosure may also include various configurations of panels. FIG. 1 shows one embodiment of a square panel component 102*a* having a first surface 105 parallel to and offset from a second surface 106. This embodiment also has a plurality of circular apertures 103*a*, 103*b*, 103*c* extending between the first surface and the second surface, and in some instances extending entirely between the first and second surfaces 105, 106 to form a hole or aperture 103*a* entirely through the panel component 102*a*. Another embodiment includes a rectangular panel having offset parallel surfaces, two sets of parallel edges where the length of one set of parallel sides of the panel is longer than the set of orthogonal sides, and a plurality of apertures extending between the offset parallel surfaces. Said another way, the apertures extend entirely through the thickness of the rectangular panel. Other embodiments may include circular panels, curved panels, angled panels, as well as various other configurations that will be apparent to one skilled in the art based on the present disclosure. Additionally, some embodiments of panels 102*a* may contain apertures with different profiles (e.g., square, polygonal, oval, and/or the like) and some embodiments of panels 102*a* may include no apertures at all.

The panel 102 may be created from a variety of materials including, inter alia, polymer materials such plastics or rubbers, metals, wood and/or the like. In some embodiments, the panel 102 is created from a first material such as nylon. Materials that increase the traction or frictional engagement between a panel 102 and a robotic toy may be added to the panel 102. For example, one or more sides of the panel 102 may be coated with a material that has a higher coefficient of friction such as a rubber or other polymer compound. In another embodiment, specific sections of the panel 102 are coated and other sections of the panel 102*a* remain uncoated. For example, a polymer such as a rubber compound may be laid down in a pattern of stripes across one of more surfaces 105 and/or 106 of the panel 102. In yet another embodiment, the construction toy system includes multiple different panels 102, with some of these panels being created from different materials. For example, panels 102 used to construct vertical walls may be created from nylon, while other panels intended to be used as ramps, and thus benefitting from greater traction between the robotic toy and the panel, may be created entirely from a higher friction rubber or silicone material. The use of a flexible, or semi-rigid material allows for various embodiments of the construction toy system to form curved walls or curved portions of a constructed structure. For example, a series of flexible walls or panels may be joined by connectors and held in place with a mat system as disclosed herein to form a semicircular wall or path.

In yet another embodiment, the panels include features, such as ridges or knurled surfaces, molded or machined directly into the panel. These features can serve to increase traction between the panel and a robotic toy. Additionally, features that direct the motion of the robotic toy can be incorporated into a set of panels. For example, a flat square panel may include a recessed curve feature extending across one of its surfaces. In this manner, a spherical robotic toy can be urged by gravity to settle into the groove and traverse the path created by the groove during motion along the panel.

FIG. 2 illustrates an embodiment of a cylindrical connector 101 from a perspective view. Connector 101 may be symmetrical in multiple dimensions. The connector 101 has a connector axis 201 extending from a first end 202*a* to a second end 202*b*. In this embodiment, the first end 202*a* and the second end 202*b* are symmetrical about plane A-A, when plane A-A is orthogonal to the connector axis 201. The connector 101 has a first retaining feature 204*a* extending about the connector axis, a second retaining feature 204*b* extending about the connector axis, and a third retaining feature 206 extending about the connector axis, which in some embodiments function together to create a securement 207. The third retaining feature 206 is located between the first retaining feature 204*a* and the second retaining feature 204*b*. In this embodiment, the first retaining feature 204*a* and the second retaining feature 204*b* are symmetrical about plane A-A.

Alternatively, the retaining features 204 can be referred to as "protrusions," which are sized so that the connector 101 can be passed through an aperture 103 in a panel 102 (see FIG. 1), and the protrusions 204 will help hold the connector 101 in place. The protrusions are located on a retaining segment, or securement, 207. Additionally, the grips 208 can be referred to as receivers 208, which have at least one prong 213 that defines at least one slot 210.

Figure 3:
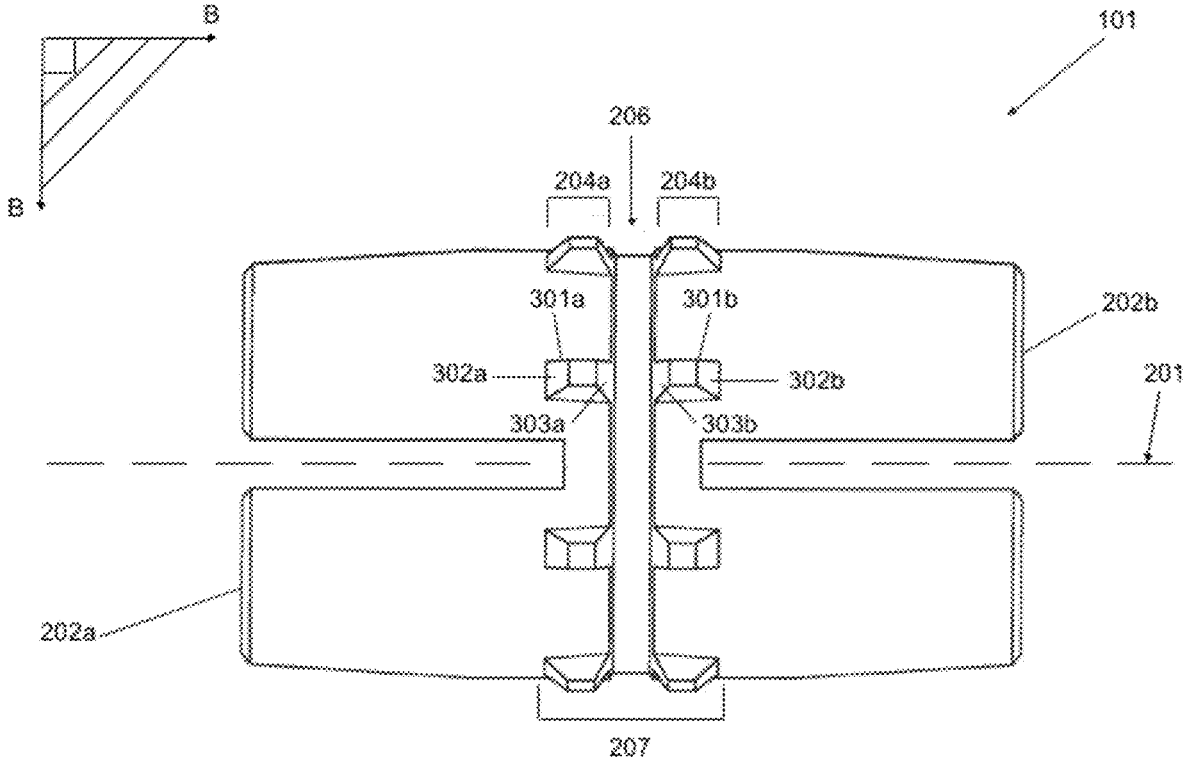
FIG. 3 shows a side view of the connector of FIG. 1.

In different embodiments, the retaining features 204 can be nubs, protrusions, lips and/or the like and/or a combination. For example, in one embodiment, the retaining features 204 may be semi-spherical protrusions extending from the surface of the connector 101. The retaining features 204 can be continuous about the axis or non-continuous. In another embodiment, the first retaining feature 204*a* has first retainers 301*a* (see FIG. 3) that are aligned with second retainers 301*b* (see FIG. 3) on the second retaining feature 204*b*. However, in an alternative embodiment the first retainers 301*a* may be offset from the second retainers 301*b*. In yet another embodiment, the third retaining feature 206 can be a groove, channel, indentation and/or the like that extends around the perimeter of the connector 101 around the connector axis 201. For example, the third retaining feature could be a semi-circular groove in the surface of the connector 101. In another embodiment, the third retaining feature 206 can be configured to conform to an edge 104 of a panel 102. In this embodiment, the third retaining feature can be a semi-circular groove and the edge 104 of the panel 102 would be semicircular feature configured to conform to the surface of the groove. Other embodiments can include differing combinations of the various features described herein. For example, in one embodiment, the connector 101 could have a first retaining feature 204*a* with multiple protruding retainers 301 as shown in FIGS. 2-3. This embodiment can include a second retaining feature 204*b* with a continuous retainer 301 extending around the entire surface of the connector 101 about the connector axis 201.

Figure 9:
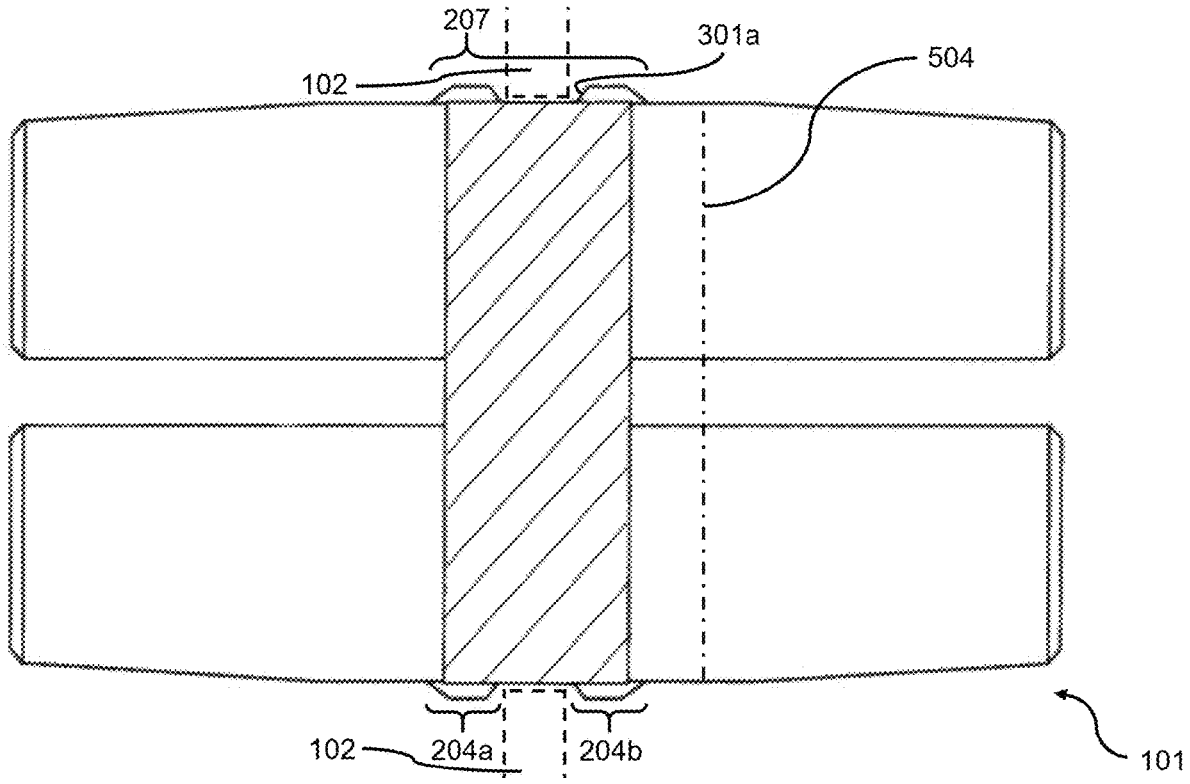
FIG. 9 shows a side, cross-sectional view of another embodiment of a connector

Further the third retaining feature 206 can be a flat surface extending between the first retaining feature 204*a* and the second retaining feature 204*b* (see FIG. 9).

Other embodiments may include a connector with different cross-sectional profiles or varying cross-sectional profiles. FIG. 2 shows an embodiment of a cylindrical connector having a circular cross-section taken on plane A-A. However, the cross-sectional profile can be oval, square, polygon (e.g., hexagon, octagon, or other regular-sided cross-sectional profile) or other shapes including cross-sectional profiles of irregular polygonal or non-polygonal shapes. Different cross-sectional profiles can be implemented to fix a first panel 102 in relation to the connector 101, such that the panel 102 would not rotate about the connector axis 201 in some embodiments. However, non-circular cross-sectional profiles can also be implemented that allow rotation of a panel 102 engaged in securement 207 such that the panel 102 can rotate about the connector axis 201. For example, in one embodiment, the cross-sectional profile of the connector 101 is an octagon. In this embodiment, the cross-sectional dimensions of the connector 101 are sized such that a maximum dimension across the octagonal cross-sectional profile taken along plane A-A would be substantially equal to or less than a cross-sectional dimension (e.g. a diameter in the case of a circular hole) of an aperture 103 extending through a panel 102.

In yet another embodiment of the connector 101, the cross-sectional profile of the securement taken on a plane A-A (or a parallel plane) has a first profile (e.g., circular, polygonal, oval, and/or the like) and a cross-sectional profile of the first grip 208*a* and/or the second grip 208*b* has a second cross-sectional profile, taken on a plane parallel and offset from plane A-A, that is different from the first profile. In one example, the first cross-sectional profile is circular and the second cross-sectional profile is square. In another embodiment of the connector 101, the first grip 208*a* has a different cross-sectional profile than the second grip 208*b*.

The connector also has a first grip 208*a* and a second grip 208*b*, which are symmetric about plane A-A in one embodiment. In the embodiment shown in FIG. 2, the first grip 208*a* comprises a first slot 210*a* and a second slot 210*b*. Each slot 210 spans the entire width of the first end 202*a* and extends from the first end 202*a* of the connector to the securement 207. The slots 210 are oriented orthogonal relative to each other about the connector axis 201 and configured to accept the edge 104 of a panel 102 and removably retain the panel within the slot 210. In one embodiment, a panel 102 is retained within the slot 210*a* through frictional engagement. Here slot 210*a* is sized such that opposite sides of the slot 210*a* contact parallel sides of a panel 102. In another embodiment, the slot 210 can vary in shape along the connector axis 201. For example, the slot 210 can become wider as it approaches the securement 207. In this embodiment, a complimentary panel 102 would become thicker toward its edge 104. Thus, the thickness dimension at the edge 104 would be larger than an opening dimension of a slot 210 at the ends 202. Thus, the panel would snap-fit into the first slot 210*a* and, once inserted into the first slot 210*a*, be retained by both frictional and normal forces. Alternatively, the panel can be slid into the slot 210*a* from the side.

FIG. 2 also shows an embodiment with slots 210 oriented orthogonal about the connector axis 201 where each slot 210 has a sets of parallel surfaces 212. The parallel surfaces form an opening in the first grip 208*a* where a panel 102 can be inserted. In other embodiments, the grips 208 can form a variety of different slot configurations. For example, instead of having a configuration with the two orthogonally oriented slots 210, the grips 208 can have one slot or three or more slots positioned at various orientations relative to each other. In these embodiments, the connector 101 can retain different numbers of panels 102 in various orientations. Further, a first slot 210*a* shown in FIG. 2 is capable of securing two panels. A first panel 102*a* can be partially inserted into slot 211*a* such that a portion of the slot from the outer surface of the connector 101 to the edge 104 of the panel 102*a* is left open. In such an embodiment, a second panel 102*b* may be inserted into the open portion of the slot 210*a* and secured in a coplanar relationship to the first panel 102*a*.

In alternative embodiments, the grips 208 may include a multitude of elongate members oriented about the connector axis 201 extending along the connector axis 201 from each side of the securement 207. In one embodiment, the elongated members can include four cylindrical rods extending from a first side of the securement 207. The rods can be oriented around the connector axis 201 and spaced to receive a panel 102 placed between the rods. In such an embodiment, the rods are spaced such that when a panel 102 is inserted between the rods it contacts adjacent surfaces of the rods and is retained through frictional and compressive forces with the rods. In another embodiment, elongated members could include more than four rods creating additional spaces between adjacent rods each capable of retaining a panel 102.

During use, the securement 207 is configured to retain a building component 102. For example, in one embodiment, a first end 202*a* may be inserted into an aperture 103, pushed or "snap-fitted" over the first retaining feature 204*a*, where the panel 102*a* is held in place by the securement 207. A second panel 102*b* may be inserted into one of the grips 208. In this embodiment, the grip 208 is sized to receive an edge 104 of the panel 102*b* and retain the panel 102*b* in a portion of the grip 208.

The elongated members can alternatively be referred to as "prongs," which also serve to define at least a portion of the slots 210, 211, and make up part of the grip portion 208 of the connector 101. FIG. 2 shows the grip 208*a* having four prongs 213 defining two slots 210*a*, 210*b*. As discussed above, these prongs 213 are not limited to the shape disclosed by FIG. 2, but could in other instances be cylindrical rods, or other elongate members that would also serve to define slots 210*a*, 210*b*, for example.

In another embodiment, the connector includes a first means for securing a building component in a first orientation relative to the connector by inserting the first means into an aperture in the building component. The connector also includes a second means for securing the building component in a second orientation relative to the connector by inserting a feature of the building component into the second means. Securing a first instance of the building component by the first means and securing a second instance of the building component by the second means orients the first instance relative to the second instance. Each means may be implemented using a combination of structural components described herein.

Various embodiments include a connector 101 extending along a connector axis 201 from a first end 202*a* to a second end 202*b*. The connector 101 includes a securement 207 having a first retainer feature 204*a* extending radially from a first location 205*a* on the connector 101, a second retainer feature 204*b* extending radially from a second location 205*b* on the connector 101, and a third retainer feature 206 extending about the connector axis 201. The third retainer feature 206 is flanked by the first retainer feature 204*a* and the second retainer feature 240*b* is snap-fitted into an aperture of a first instance of a building structure (e.g., a panel 102*a*). The connector 101 further includes a first grip 208*a* extending from the first end 202*a* toward the securement 207 along the connector axis 201. The first grip 208*a* is sized to receive a feature of a second instance of the building structure (e.g., an edge 104 of a panel 102*b*).

FIG. 3 Illustrates an embodiment of the connector 101 from a side view. In this embodiment, the first retaining feature 204*a* contains multiple retainers 301 on the surface of the connector 101. The retainers 301 encircle the connector axis 201. Each retainer 301 may have an outer ramp 302 and an inner ramp 303. The outer ramp 302 tapers outward from the body of the connector 300 and facilitates snap-fitting a building component 102 onto the securement 207. The inner ramp 303 tapers outward from the third retaining feature 206 and facilitates removing a building component 102 from the securement 207.

In another embodiment, the first retaining feature 204*a* may comprise a single retainer 301 on the surface of the connector 101 that completely encircles the connector 101 around the connector axis 201. Many different numbers of retainers 301 may encircle the connector 101. Further, in another embodiment, the retainer(s) 301*a* on the first retainer feature 204*a* may take on a different configuration than the retainer(s) 301*b* on the second retainer feature 204*b*. For example, the first retainer feature 204*a* may contain multiple retainers 301*a* on the surface of the connector 101 encircling the connector 101 and the second retainer feature 204*b* may contain a different number of retainers 301*b* with a different configuration. In one configuration, the second retainer feature 204*b* may have retainers 301*b* that have an inner ramp 303*b* that is substantially orthogonal to the connector axis 201.

In yet another embodiment, an outer dimension of the connector 101 (e.g. an outer diameter of the connector 101 in the case of a round connector 101) tapers outwardly from the first end 202*a* toward the securement 207. This taper facilitates inserting the first end of the connector into an aperture 103 of a panel 102.

Figure 4:
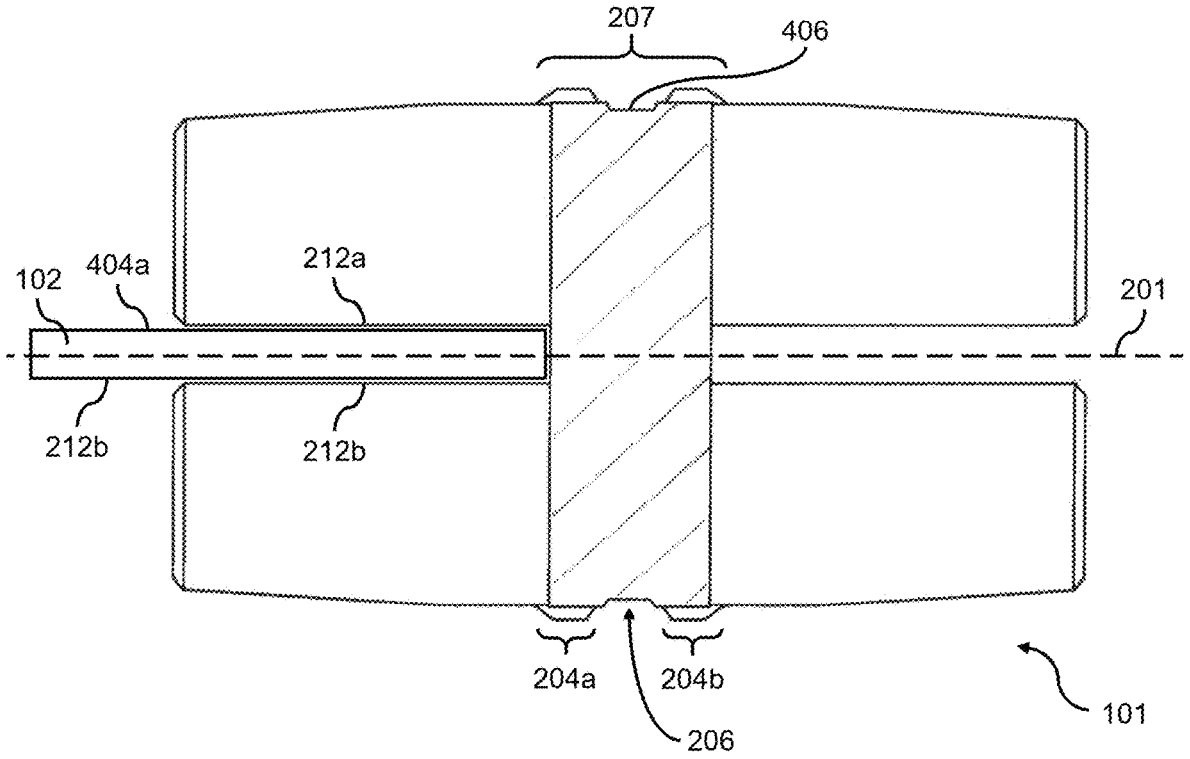
FIG. 4 shows a side, cross-sectional view of the connector of FIG. 1.

FIG. 4 illustrates a cut-away side view of the connector 101 taken along plane B-B of FIG. 3. As shown, the slot 210*a* is formed by two parallel and offset surfaces 212*a*, 212*b*. In this embodiment, a panel 102 may be inserted between the parallel surfaces 212 and held in place by frictional forces and/or compressive forces imparted due to elastic deformation of the slot 210*a* upon insertion of the panel 102. That is, the thickness of the panel 102 and the distance between the parallel surfaces 212 are configured such that when the panel is inserted between the parallel surfaces 212, the panel is retained. The panel 102 is retained such that it remains securely in place during use, but can be removed from the slot 210*a* by a user pulling or sliding it out.

In the embodiment shown in FIG. 4, the third retainer feature 206 contains a recess 406 in the surface of the connector 101 that encircles the connector 101 about the connector axis 201. When a panel 102 is snap fit into the securement 207, an inner surface of an aperture 103*a* of the panel may rest in the recess 406. In another embodiment, the third retainer feature 206 may include a generally flat surface without a recess, and an inner surface of an aperture 103*a* of panel 102 engaged by the securement 207 may rest on the surface of the connector 101 extending between the first retainer feature 204*a* and the second retainer feature 204*b* (see FIG. 9).

Figure 5:
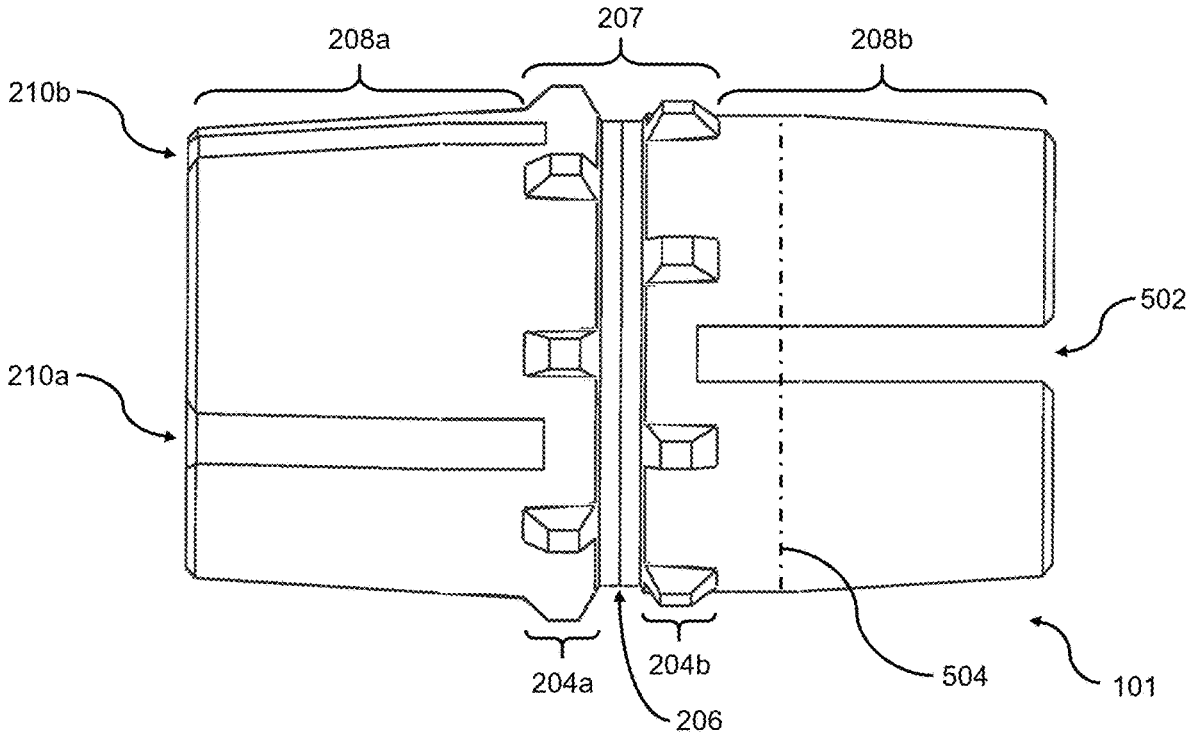
FIG. 5 shows a side view of another embodiment of a connector.
Figure 10:
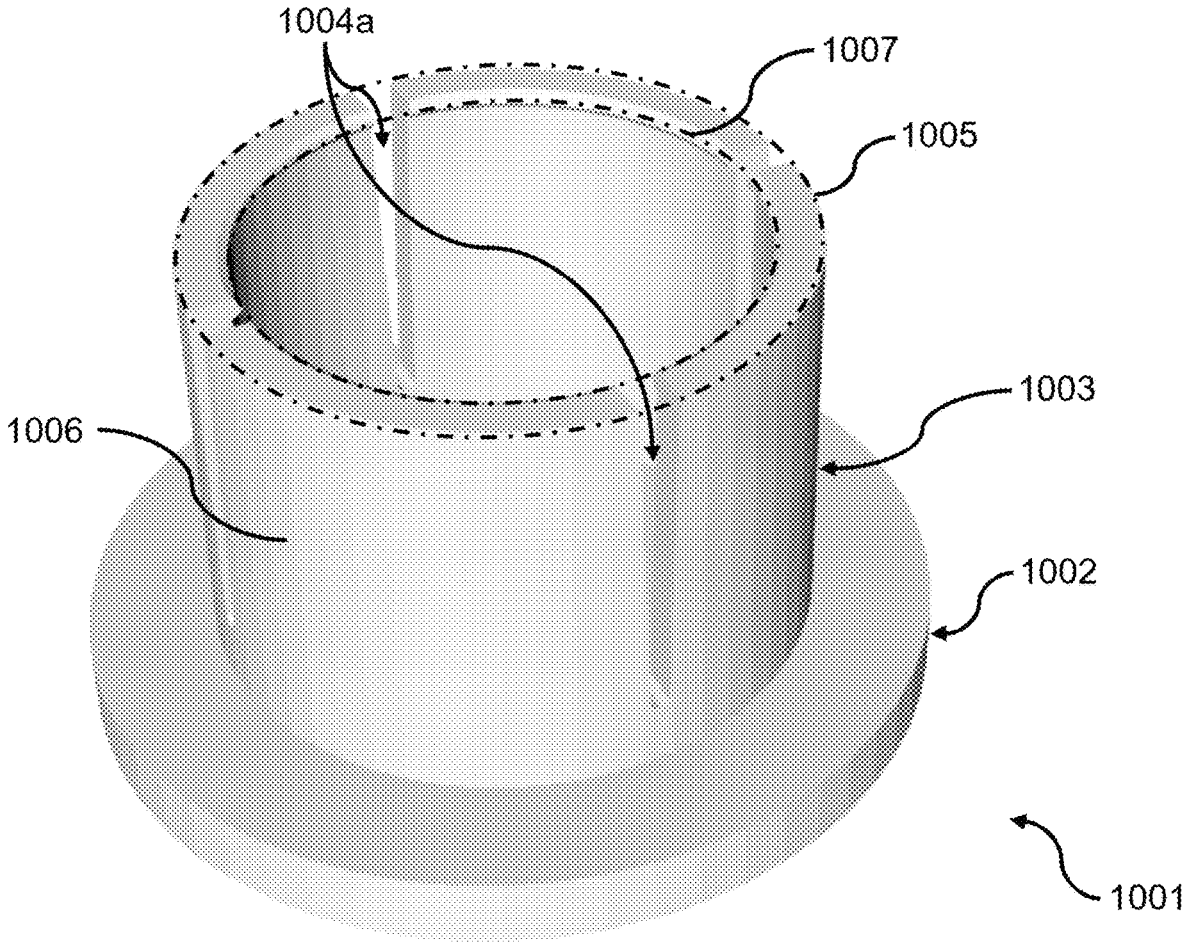
FIG. 10 shows a perspective view of an embodiment of a receptacle.

FIG. 5 illustrates a perspective view of one embodiment of the connector 101. In this embodiment, the connector 101 has a first grip 208*a* that is offset relative to the second grip 208*b*. That is, the first slot 210*a* on the first grip does not align with a slot 502 on the second grip. Further, in some embodiments the first retainer feature 204*a* does not align with the second retainer feature 204*b*. In one embodiment, the first grip 208*a* can rotate relative to the second grip 208*b*. In this embodiment, the first grip 208*a* and the second grip 208*b* are connected such that a user can rotate them to desired orientations relative to each other. In this embodiment, the first retainer feature 204*a* also rotates relative to the second retainer feature 204*b*. An outer dimension 504 of the receiver of the connector 208 (where the dimension of the receiver of the connector 208 is a diameter when the receiver of the connector 208 is circular) is sized so as to be received by the receptacle 1001 as shown in FIG. 10. In another embodiment, the connector could be assembled from three separate subcomponents. In this embodiment, the first grip 208*a* would be a first subcomponent, the second grip 208*b* would be a second subcomponent and the securement 207 would be a third subcomponent. These subcomponents can be assembled through processes such as press-fitting, snap-features, screw type mating, and/or the like. In this embodiment, the grips 208 can rotate relative to each other and relative to the securement 207. Therefore, the first retainer feature 204*a* would not rotate relative to the second retainer feature 204*b*.

Figure 6:
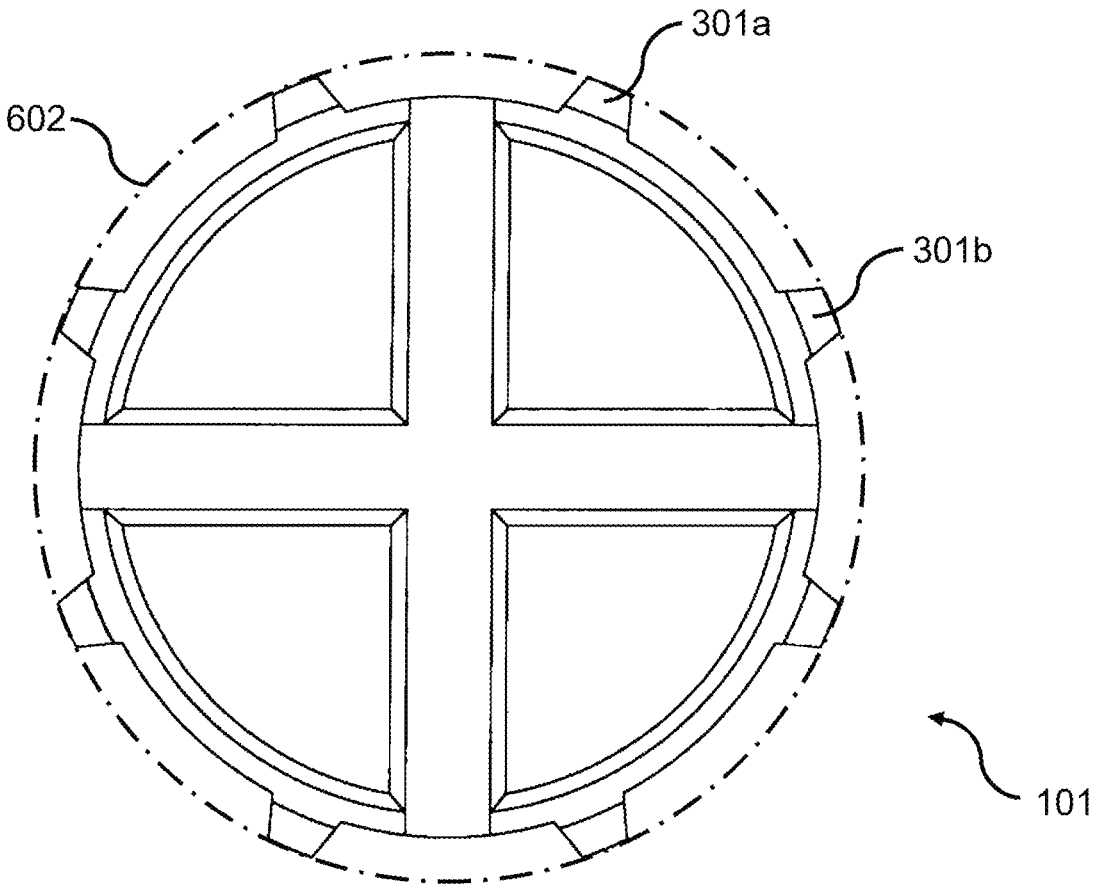
FIG. 6 shows an end view of the connector of FIG. 1.

FIG. 6 illustrates an end view of the connector 101. A circular dimension 602 extending around an outer dimension of the retainers 301 is larger than a dimension of the apertures 103 (where the dimension of the aperture is a diameter when the aperture 103 is circular) on a panel 102. Thus, when the connector 101 is inserted into an aperture 103, the aperture 103 of the panel may expand or change shape to slide over the first retainer feature 204*a* or the second retainer feature 204*b*. Additionally, the connector 101 may also contract or change shape to allow the aperture 103 of the panel to slide over one of the retainer features 204. For example, in an embodiment where the connector 101 is made from a polymer material, inserting the connector 101 into an aperture 103 can cause the connector to compress and/or change shape such that the outer sides of the aperture 103 can slide past the retainer features 204. Once the panel 102 has passed either retainer feature, the aperture 103 returns to its resting shape and may be retained by the first retainer features 204, the recess 406, or a combination of these features.

Figure 7:
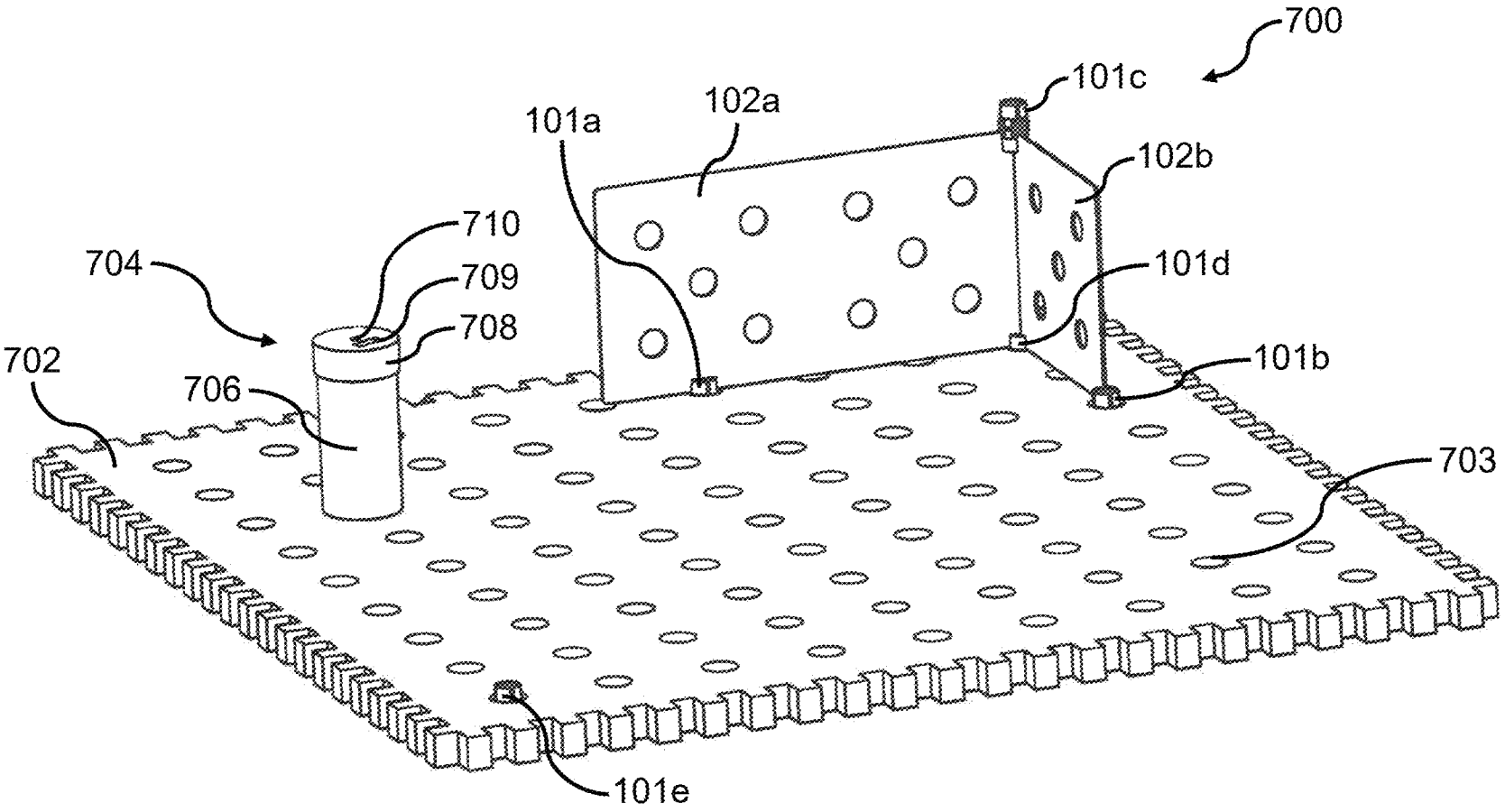
FIG. 7 shows a perspective view of a construction toy system including various building components.

FIG. 7 illustrates another embodiment of a construction toy system 700 including various building components. The construction toy system 700 includes various building components such as a mat 702, connectors 101, various configurations of panels 102, and sensors. The connector 101 is attached to the mat by inserting one end 202 into one of the apertures 703 located in the mat. In an alternative embodiment, the mat or other base structure has an edge feature similar to the panel 102 edge 104 and the connector 101 is secured to the mat by inserting a grip 210 onto that edge feature. The construction toy system may include multiple or numerous mats 702, connectors 101, panels 102, and sensors. For instance, one system may include multiple mats 702 configured to interlock together and build an expandable base on which the toy system can be built. Each of the mats may have similar features and structures or may differ in shape and size. Regardless, the mats 702 in such an expandable system would all be compatible with connectors 101, panels 102, sensors, and other components that may be added to the system.

When the connector 101 is secured to the mat it can be used to secure a panel 102 in a vertical orientation. In this manner, a user may choose which aperture 103 in the mat to insert the connector into and various structures may be created by a user utilizing the multiple connectors 101 to secure panels 102 to the mat as well as to secure a first panel 102*a* to a second panel 102*b*. In the embodiment shown in FIG. 7, the connector is used to secure a sensor housing 706 to the mat. The sensor housing 706 may contain a variety of sensor electronics such as force sensors, strain gauges, thermal sensors, light sensors, and/or the like. The sensors are configured to communicate with other components of the construction toy system. For example, a first force sensor may send a wireless signal to other sensors indicating that the first force sensor was contacted.

In another embodiment, the sensor housing 706 includes a removable cap 708. The cap 708 allows access to the sensor electronics and is removable to permit removal of a sensor from the sensor housing 706 and replacement with a different sensor. Additionally, the sensor cap allows access to other components such as batteries that may be contained in the sensor housing 706. In yet another embodiment, the sensor housing may have an on-off switch 709 or can be made to turn off automatically. The sensor may further have a light indicator 710 that can be used in a variety of modes. In one such mode, the light indicator 710 displays different colors or blinks in a certain pattern to indicate that it is active. Alternatively, the light indicator 710 can react in response to instructions from the sensor electronic. In another embodiment, multiple lights can be placed at various locations on the sensor housing 706 and/or the cap 708.

Figure 8:
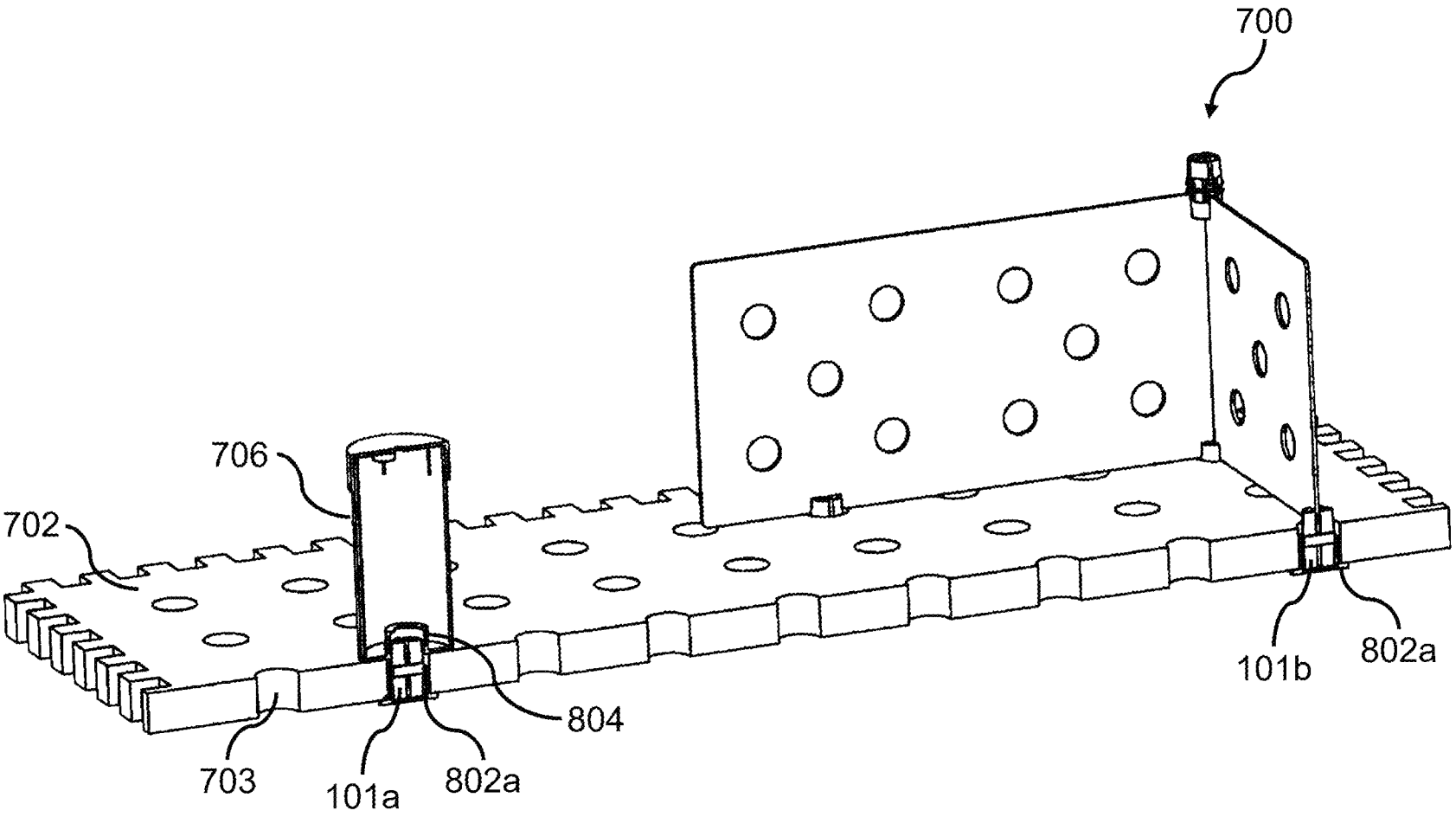
FIG. 8 shows a cut-away view of the construction toy system of FIG. 7.

FIG. 8 illustrates a cut-away view of the construction toy system 700 illustrated in FIG. 7. As shown, a plug 802 is inserted into an aperture 703 from the bottom side of the mat 702. The plug 802*a* is configured to receive an end 202 of the connector 101*a* and secure the connector 101*a* to the mat 702. The unsecured end 202 of the connector 101 extends from the top surface of the mat 702 and can engage with various building components such as a panel 102 or sensor housing 706. For example, when a first end 202*a* of the connector 101 is inserted into plug 802*a*, the second end 202*b* of the connector 101 is inserted into a receiver 804 on the sensor housing 706. In various embodiments, the connector 101 can rotate relative to a plug 802*a*. For example, a first end 802*a* of a connector 101 can be inserted into a plug 802 and the second grip 208 can secure a panel 102. Then both the connector 101 and panel 102 may rotate relative to the plug 802 and if the plug is inserted into a mat 702 these components also rotate relative to the mat 702. In another embodiment, the plug 802 can rotate relative to the mat 702. In this embodiment, a connector 101 inserted into the receiver 804 of the plug 802 would also rotate relative to the mat.

FIG. 9 illustrates a cut-away side view of an embodiment of the connector 101. In this embodiment, the retaining segment 207 differs from that pictured in FIG. 4, as it does not have a recess 406. In this embodiment, a panel 102 is snap fit into the retaining segment 207, and an inner surface of an aperture 103*a* of the panel may rest on the surface of the connector 101 between the protrusions 204. This embodiment of the connector 101 functions and interfaces with other components of the system such as panels 102 or walls, sensors, housings, supports, and other parts of the construction toy system. An outer dimension 504 of the receiver of the connector 208 (where the dimension of the receiver of the connector 208 is a diameter when the receiver of the connector 208 is circular) is received by the receptacle 1001 as shown in FIG. 10. This embodiment may be formed through any of the methods of manufacture mentioned herein, and the simplified geometry may increase the manufacturability of the connector 101. Other simplifications or alterations to the connector 101 and other parts of the system such as alterations of size, shape, specific geometry, and material may be used.

FIG. 10 illustrates a perspective view of an embodiment of a receptacle 1001. In this embodiment of the receptacle 1001, the base 1002 of the receptacle is shown having a circular shape, though other shapes and proportions can be used. The receptacle 1001 features a tubular end 1003 opposite the base 1002 which is shaped and configured to receive a connector 101, for example. According to some embodiments, the base 1002 is a lip. The tubular body 1003 (or middle section of the receptacle) has multiple slots 1004. Though two perpendicular slots 1004 are shown other numbers and configurations of slots can be employed. For example, in one embodiment, a single slot 1004*a* extends across the diameter of the receptacle 1005; in yet another embodiment, there may be three or more slots 1004 extending across a dimension of the tubular body of the receptacle 1005 (where the dimension of the tubular body of the receptacle 1003 is a diameter when the tubular body of the receptacle 1003 is circular) at varying angles with respect to each other. The slots 1004 (or gaps, or openings) in the walls of the body of the receptacle 1001 allow the perimeter of the receptacle body 1006 to flex outwardly to accept a connector 101 and releasably retain the connector 101 in place. The receptacle 1001 can be inserted into an opening 703 of a mat 702 as shown in FIG. 8. The tubular body of the receptacle 1003 can have an inner dimension 1007 (where the inner dimension of the tubular body of the receptacle 1003 is a diameter when the tubular body of the receptacle 1003 is circular) that is greater than a first outer diameter of a receiver of a connector 504 as shown in FIGS. 5 and 9. The receptacle 1001 also holds and/or supports other components of the toy system such as, for example, connectors, walls 102, sensors, sensor housings, flag poles, and various other components.

Figure 11:
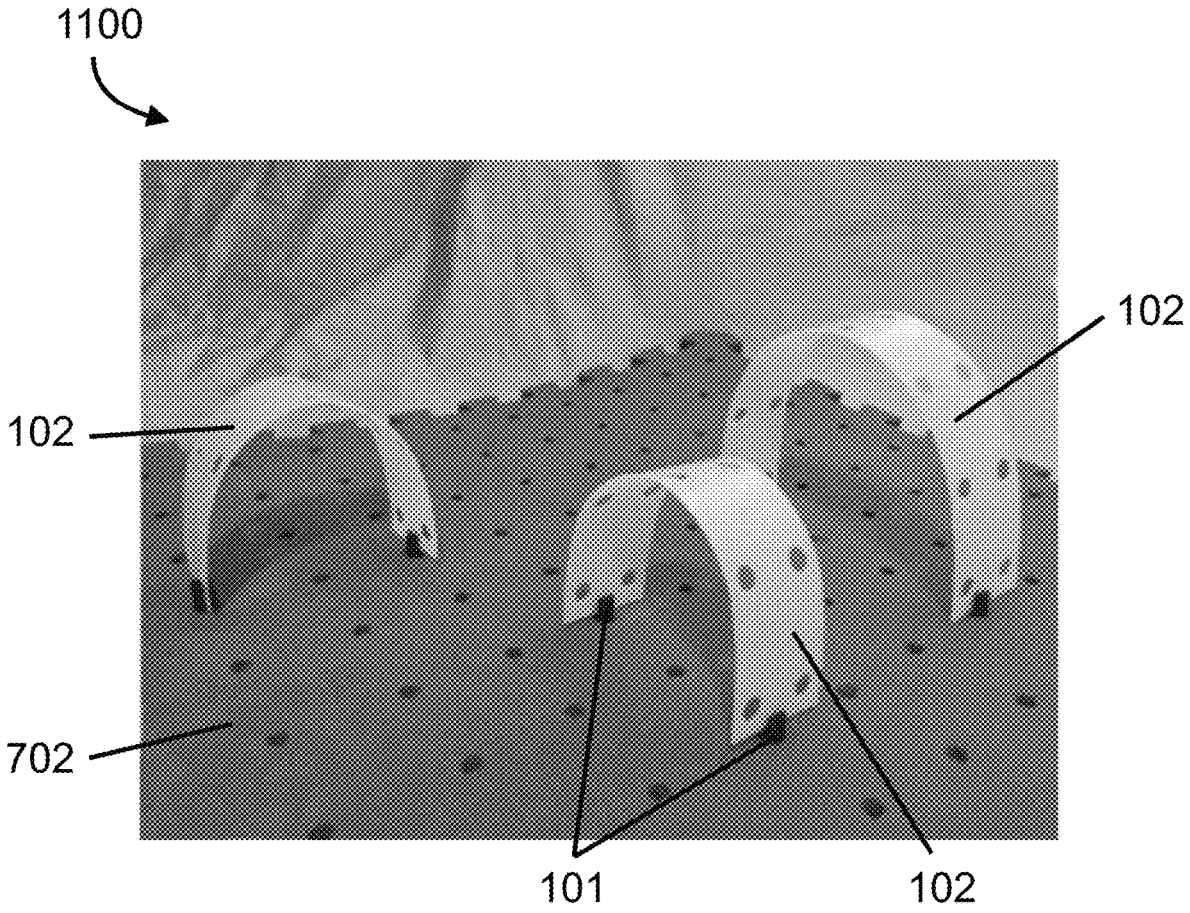
FIG. 11 shows an embodiment of a course built using the construction toy system.

FIG. 11 illustrates an example of a course or implementation of the construction toy system. Though many different configurations are possible, this configuration of a course 1100 shows panels 102 made of a flexible yet somewhat rigid material as described above connected to a mat 702 on one end using at least one connector 101 and a receptacle (not shown), and then bent into an arch shape and secured to the mat using another connector 101 and another receptacle (not shown). In this course 1100, the object may be to pass through the various arches formed by the panels 102 and connectors 101 in a particular order or in a particular period of time. This allows users to create a game which may be changed through any different configuration of the course 1100. The panels 102 may also be curved in other dimensions, such as to form curved or semi-circular walls rather than arches. And multiple panels 102 of different shapes and sizes may be used to create a longer curved section.

Figure 12:
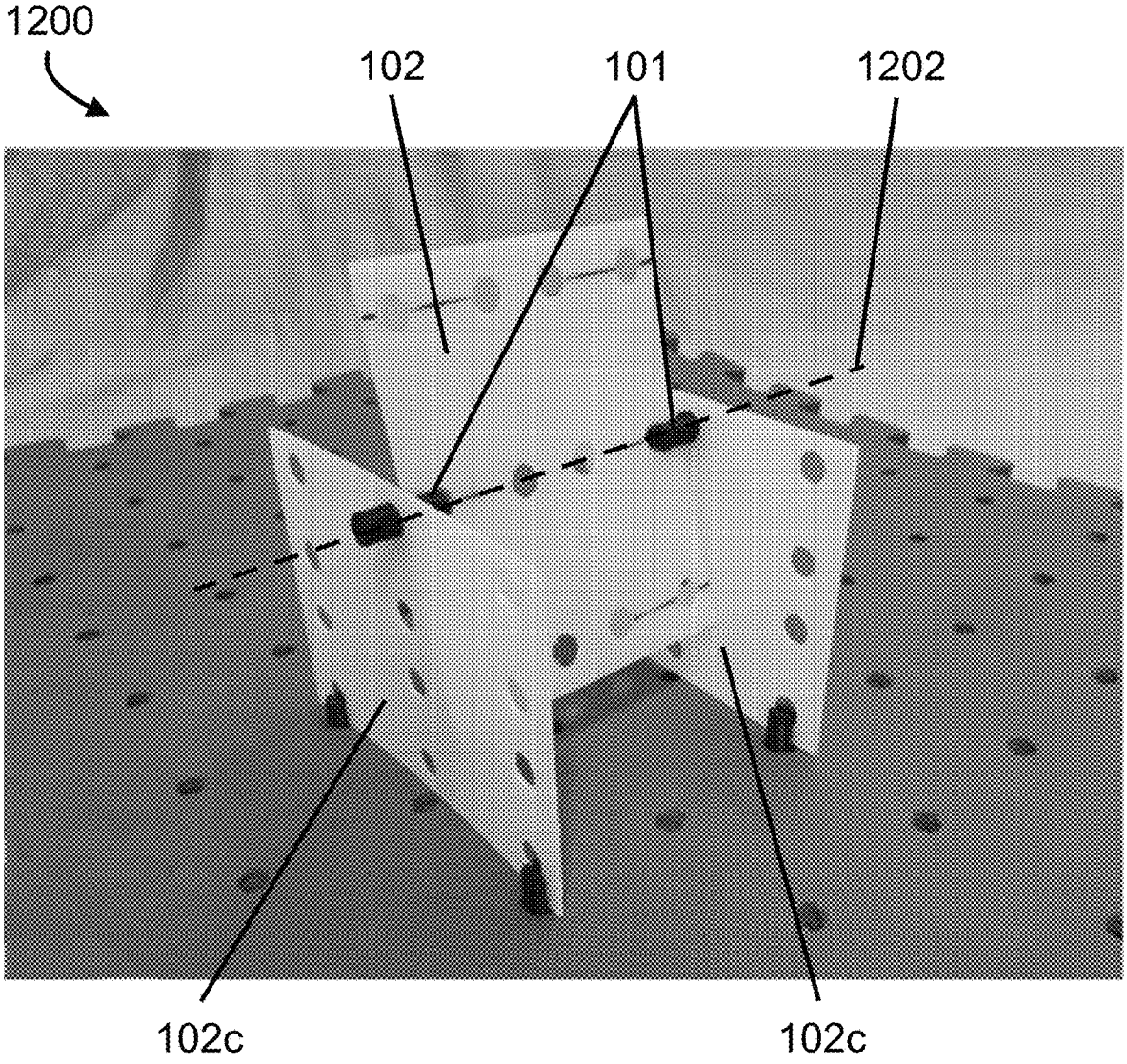
FIG. 12 shows an embodiment of a gate build using components of the construction toy system.

FIG. 12 illustrates an example of a rotating door or gate 1200 that may be built using various elements of the construction toy system. This gate 1200 allows a panel 102 to rotate on an axis 1202. The panel 102 is secured or gripped by connectors 101 on either side along the direction of the axis 1202, with the connector 101 gripping the panel with a slot as described herein. The connectors 101 are then each retained in an aperture of secondary wall or support panels 102*c* according to embodiments described herein. With the connectors 101 retained in the aperture of the support panels 102*c*, the connectors 101 are free to rotate around the axis 1202. The free rotation of the connectors 101 also allows and causes rotation of the panel 102 thereby forming a rotating or revolving door or gate 1200. This gate 1200 may be used as part of a larger course or system of construction as described herein. For instance, the gate 1200 may be incorporated as part of a course 1100 such as pictured in FIG. 11. In such an embodiment, the gate may be used as part of an obstacle or other course used in a game through which users may direct a smart toy or other remotely operated toy. The gate 1200 may also be configured to rotate on an axis different from axis 1202. For instance, the gate 1200 may be built to have a vertical axis around which the gate 1200 rotates, or may incorporate more than one panel 102 to build a larger door or a swinging set of doors similar to saloon doors.

Figure 13:
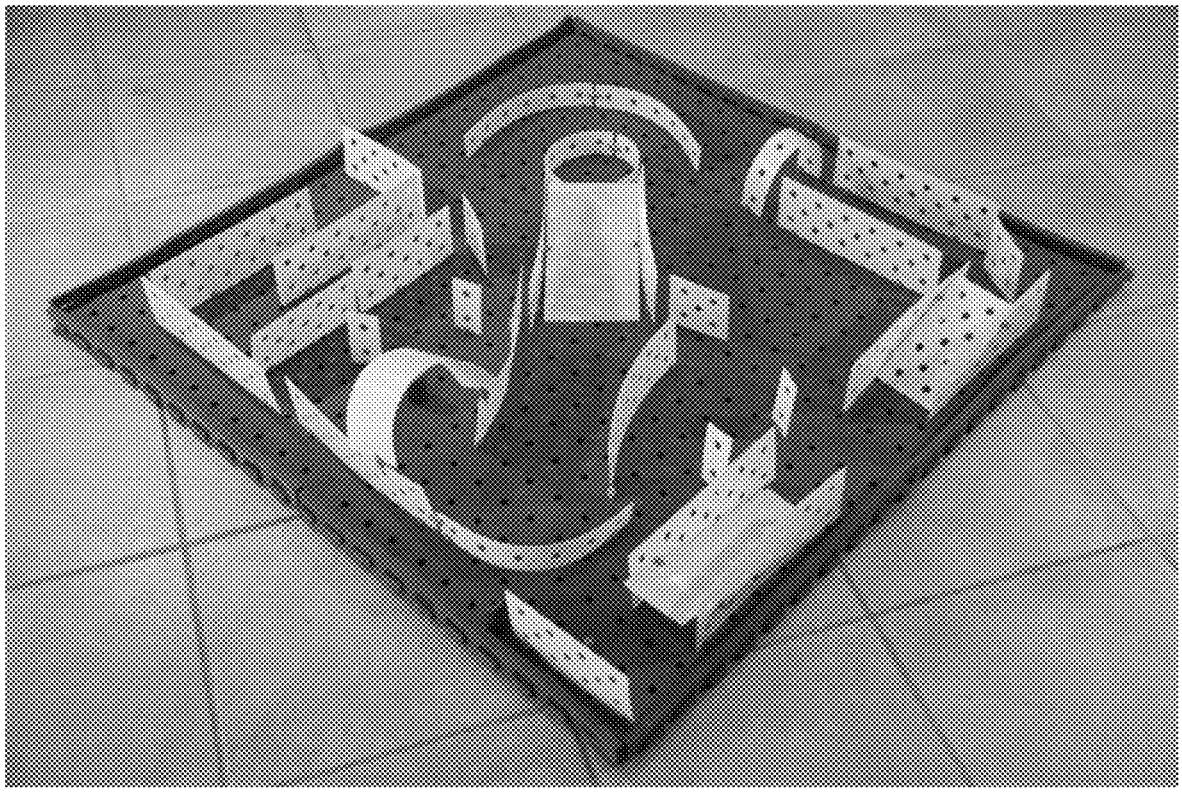
FIG. 13 shows an embodiment of a maze build using components of the construction toy system.

FIG. 13 illustrates an example of a perspective view of a maze 1300 that may be built using various elements of the construction toy system. This figure illustrates a complex maze build, with features similar to those depicted in FIG. 11 and FIG. 12.

While a number of aspects and embodiments have been discussed above, persons having ordinary skill in the art will recognize certain modifications, permutations, additions, and equivalents may alternatively be used or introduced. It is intended that the scope of the following claims be interpreted to include all such modifications, permutations, additions, and equivalents. The terms and expressions used herein are for description, not limitation, and there is no intention to exclude any equivalents of the aspects shown and described.

In addition, any workable combination of the features and elements disclosed herein can be employed.

Having described several embodiments, it will be recognized by those of skill in the art that various modifications, alternative constructions, and equivalents may be used without departing from the spirit of the disclosure. Additionally, a number of well-known processes and elements have not been described in order to avoid unnecessarily obscuring the present disclosure. Accordingly, the above description should not be taken as limiting the scope of the disclosure.

What is claimed is:

1. A toy system comprising:

a connector having a cylindrical body formed about an axis, the cylindrical body having a first end, the cylindrical body comprising:

a retaining segment, wherein the retaining segment has at least one lip, and wherein the at least one lip is sized so as to resist the passing of the cylindrical body through an aperture of a panel in a direction of the axis, is sized to retain the connector in the panel when the first end of the cylindrical body is within the aperture, and comprises three or more protrusions that collectively define a maximum circumference of the connector, wherein the three or more protrusions are equally spaced circumferentially about the connector; and a receiver abutting the retaining segment, wherein the receiver has at least one prong extending from the retaining segment in the direction of the axis, and the at least one prong defines a first slot that extends across a width of the first end, a second slot that extends across the width of the first end, the first slot intersecting the second slot, wherein the first and second slots of the at least one prong are each configured to accept an edge of the panel.

2. The toy system of claim 1, further comprising the panel.

3. The toy system of claim 2, wherein the connector grips the panel when the panel is inserted into one of the first slot or the second slot.

4. The toy system of claim 2, wherein the panel is configured to rotate about the connector at the retaining segment when the connector has been inserted through the aperture in the panel.

5. The toy system of claim 2, wherein the panel is at least partially made of a flexible material.

6. The toy system of claim 1, further comprising a receptacle with a tubular end, the tubular end sized and shaped so as to receive the receiver.

7. The toy system of claim 1, further comprising a sensor.

8. The toy system of claim 7, wherein the sensor is a force sensor, a strain gauge, a thermal sensor, a sound sensor, or a light sensor.

9. The toy system of claim 7, further comprising a sensor housing configured to accept the sensor.

10. The toy system of claim 1, wherein the receiver is a first receiver, wherein the connector further comprises a second receiver that abuts the retaining segment opposite the first receiver and extends from the retaining segment in the direction of the axis, and wherein the second receiver defines a third slot, wherein the retaining segment separates the first and second slots from the third slot.

11. The toy system of claim 10, wherein the retaining segment comprises a first lip and a second lip, a channel is disposed between the first lip and the second lip, the channel is equidistant from the first receiver and the second receiver, the channel spans an entirety between the first lip and the second lip, and the channel is uninterrupted between the first and second lips.

12. The toy system of claim 1, wherein the retaining segment has a solid core.

13. A cylindrical connector extending along an axis from a first end to a second end, the cylindrical connector comprising:

a securement formed about the axis, the securement having:

a first retainer extending radially from the axis, wherein the first retainer protrudes from an outer surface of the cylindrical connector and has a first circumference;

a second retainer extending radially from the axis, wherein the second retainer protrudes from the outer surface of the cylindrical connector and has a second circumference equivalent to the first circumference;

a first middle section of the first retainer extends further in a radial direction from the axis than sections of the first retainer adjacent to the first middle section and a second middle section of the second retainer extends further in a radial direction from the axis than sections of the second retainer adjacent to the second middle section;

a third retainer extending radially from the axis, the third retainer being positioned equidistant from the first retainer and the second retainer, spanning an entirety of a gap between the first retainer and the second retainer, and having a third circumference shorter than the first circumference and second circumference, wherein the third circumference is uninterrupted between the first and second retainers;

a first grip extending from the securement to the first end, the first grip having a first slot that extends across a width of the first end, a second slot that extends across the width of the first end, the first slot intersecting the second slot, wherein the first and second slots of the first grip are configured to accept an edge of a panel; and a second grip extending from the securement to the second end, the second grip having a third slot that extends across a width of the second end, a fourth slot that extends across the width of the second end, the third slot intersecting the fourth slot, wherein the third and fourth slots of the second grip are configured to accept the edge of the panel.

14. The cylindrical connector of claim 13, wherein the first slot is perpendicular to the second slot.

15. The cylindrical connector of claim 13, wherein the first retainer is a plurality of protrusions and the second retainer is a plurality of protrusions.

16. The cylindrical connector of claim 13, wherein the first circumference and the second circumference are an outermost circumference of the cylindrical connector.

17. The cylindrical connector of claim 13, wherein the third retainer includes one or a combination of a groove, a channel, and an indentation.

* * * * *